US010450822B2

(12) United States Patent
Bories et al.

(10) Patent No.: US 10,450,822 B2
(45) Date of Patent: Oct. 22, 2019

(54) HANGER RUNNING SYSTEM AND METHOD

(71) Applicant: Cameron International Corporation, Houston, TX (US)

(72) Inventors: Sebastien Noel Albert Bories, Nissan-lez-enserune (FR); Patrice Paul Louis Couren, Lieuran-les-Beziers (FR); Brandon Blake Shirley, Cypress, TX (US); Si Hui Koh, Singapore (SG); Haw Keat Lim, Singapore (SG)

(73) Assignee: Cameron International Corporation, Houston, TX (US)

( * ) Notice: Subject to any disclaimer, the term of this patent is extended or adjusted under 35 U.S.C. 154(b) by 374 days.

(21) Appl. No.: 15/286,061

(22) Filed: Oct. 5, 2016

(65) Prior Publication Data

US 2017/0152721 A1 Jun. 1, 2017

(30) Foreign Application Priority Data

Dec. 1, 2015 (EP) ..... 15306907

(51) Int. Cl.
*E21B 33/04* (2006.01)
*E21B 33/047* (2006.01)
*E21B 23/00* (2006.01)

(52) U.S. Cl.
CPC ..... *E21B 33/04* (2013.01); *E21B 33/047* (2013.01); *E21B 23/00* (2013.01)

(58) Field of Classification Search
CPC ..... E21B 33/04; E21B 33/047; E21B 33/0407
See application file for complete search history.

(56) References Cited

U.S. PATENT DOCUMENTS 4,600,058 A 7/1986 Van Wormer et al.
5,906,240 A * 5/1999 Kilgore ..... E21B 23/01 166/206
6,082,460 A 7/2000 June
2011/0005774 A1 1/2011 Sinnott et al.
(Continued)

FOREIGN PATENT DOCUMENTS

AU 2012216766 A1 11/2013
EP 0898048 A2 9/1999

OTHER PUBLICATIONS

PCT International Search Report & Written Opinion for PCT Application No. PCT/IB2017/050421 dated Apr. 25, 2017; 16 Pages.

(Continued)

*Primary Examiner* — Kristyn A Hall
(74) *Attorney, Agent, or Firm* — Fletcher Yoder, P.C.

(57) ABSTRACT

A system includes a hanger locking assembly configured to lock a hanger within a housing of a wellhead. The hanger locking assembly includes an energizing ring having one or more axially-extending passageways configured to receive and to support one or more control lines. An anti-rotation element extends between the energizing ring and the hanger to block rotational movement of the energizing ring relative to the hanger. A locking ring is in contact with the energizing ring, and axial movement of the energizing ring relative to the hanger drives the locking ring radially to engaged position in which the locking ring extends into a corresponding recess of the housing of the wellhead to block axial movement of the hanger relative to the wellhead.

20 Claims, 10 Drawing Sheets

(56) References Cited

U.S. PATENT DOCUMENTS

| | | | | |
|---|---|---|---|---|
| 2013/0075103 | A1* | 3/2013 | Herbel | E21B 33/043<br>166/339 |
| 2015/0252635 | A1 | 9/2015 | Hartley et al. | |

OTHER PUBLICATIONS

SSMC™ Wellhead System, Standard Snapring Modular Compact Wellhead, Cooper Cameron Corporation, Cameron Division, US, Jul. 1999, 8 pgs.

* cited by examiner

HANGER RUNNING SYSTEM AND METHOD

CROSS-REFERENCE TO RELATED APPLICATION

This application claims priority from and the benefit of European Patent Application Serial No. EP15306907.5, entitled "HANGER RUNNING SYSTEM AND METHOD," filed Dec. 1, 2015, which is hereby incorporated by reference in its entirety for all purposes.

BACKGROUND

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Natural resources, such as oil and gas, are used as fuel to power vehicles, heat homes, and generate electricity, in addition to various other uses. Once a desired resource is discovered below the surface of the earth, drilling and production systems are often employed to access and extract the resource. These systems may be located onshore or offshore depending on the location of a desired resource. Further, such systems generally include a wellhead assembly through which the well is drilled. These wellhead assemblies may include a wide variety of components and/or conduits, such as various casings, hangers, valves, fluid conduits, and the like, that control drilling and/or extraction operations. In drilling and production systems, a hanger may be used to suspend strings (e.g., piping) within the well to facilitate extraction of the resource. Such hangers may be disposed within and supported by a housing (e.g., a spool or a bowl) of the wellhead.

In some cases, a tool is utilized to facilitate running (e.g., lowering) the hanger into the wellhead. Once the hanger is in a landed position within the wellhead, the hanger may be locked (e.g., mechanically locked) into position within the wellhead. Throughout the process of running and locking the hanger within the wellhead, it may be desirable to control downhole components (e.g., valves) via one or more control lines (e.g., hydraulic and/or electric control lines) to block pressure release from the well, for example. Unfortunately, typical tools and associated components for running and locking the hanger within the wellhead may not enable efficient installation of the hanger and/or may interfere with the use of and/or monitoring of control lines during the installation process.

BRIEF DESCRIPTION OF THE DRAWINGS

Various features, aspects, and advantages of the present invention will become better understood when the following detailed description is read with reference to the accompanying figures in which like characters represent like parts throughout the figures, wherein.

DETAILED DESCRIPTION OF SPECIFIC EMBODIMENTS

Figure 1:
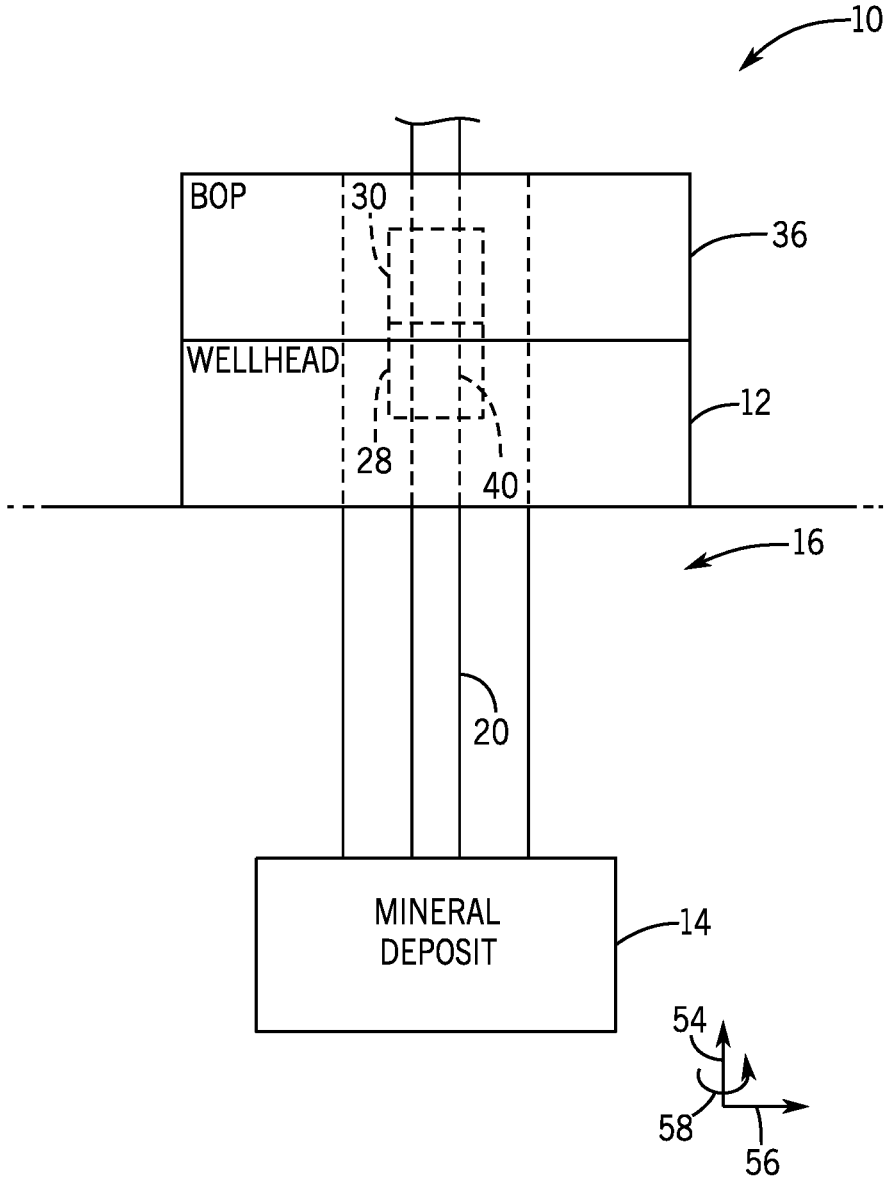
FIG. 1 is a block diagram of a mineral extraction system in accordance with an embodiment of the present disclosure.

One or more specific embodiments of the present invention will be described below. These described embodiments are only exemplary of the present invention. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Certain exemplary embodiments of the present disclosure relate generally to hanger running systems and methods that enable use of continuous and/or non-continuous control lines during installation of a hanger within a wellhead of a mineral extraction system and/or provide positive locking of the hanger within the wellhead of the mineral extraction system. For example, certain disclosed embodiments may advantageously provide a simple, low-cost system for efficiently running and/or positively locking the hanger within the wellhead. For example, the disclosed embodiments may enable running and locking the hanger within the wellhead with only a single trip (e.g., pass) of a tool (e.g., the hanger running tool) through a blowout preventer (BOP). The disclosed embodiments may facilitate the installation of control lines through the hanger and enable testing (e.g., pressure testing from the surface/rig floor) seals installed between the control lines and a hanger body while a hanger running tool remains mounted on a hanger neck (e.g., without separating the hanger running tool from the hanger). The disclosed embodiments may enable use of a large number of control lines (e.g., more than 5, 6, 7, 8, 9, 10, 11, 12) and/or facilitate monitoring of the control lines during installation of the hanger within the wellhead. The disclosed embodiments may facilitate the use of continuous control lines and/or be devoid of costly and/or complex components, such as bushings, to manage the control lines during installation of the hanger.

As discussed in more detail below, the disclosed embodiments may include a system having a hanger running assembly that is configured to run (e.g., lower) the hanger into the wellhead and/or a hanger locking assembly that is configured to install (e.g., lock) the hanger into the wellhead. The hanger locking assembly may include at least an energizing ring (e.g., annular energizing ring) and a locking ring (e.g., annular locking ring). In certain embodiments, the hanger locking assembly includes a retainer ring (e.g., hold-down ring). In certain embodiments, the hanger running tool may be configured to drive the energizing ring axially toward the well, which in turn drives the locking ring radially outward to engage a corresponding recess in a housing of the wellhead, thereby locking the hanger within the housing of the wellhead. In certain embodiments, the energizing ring and the locking ring may be configured to positively lock (e.g., block axial movement of the hanger) within the housing of the wellhead.

An anti-rotation component may be used to block rotation of the energizing ring about the hanger, and the energizing ring may include one or more axially-extending passageways each configured to receive and/or to support one or more control lines. Accordingly, one or more control lines may extend through the energizing ring. In some embodiments, the one or more control lines may be continuous control lines (e.g., without connectors, breaks, or interruptions) during installation of the hanger and/or after termination of the one or more control lines. For example, one or more control lines may be continuous from above the hanger (e.g., the surface), through an annular space between the hanger running tool and the wellhead, and through the energizing ring (e.g., from an upper surface to a lower surface of the energizing ring) during installation of the hanger. In some embodiments, the one or more control lines may be configured to be continuous between a termination point of the control line and a lower surface of the hanger after installation of the hanger. Furthermore, the components (e.g., the hanger running tool) of the hanger running assembly may not interfere with (e.g., may not block a flow of fluid through the one or more control lines, twist, break, impede, pinch, or the like) and/or contact the one or more control lines during running and locking of the hanger within the wellhead.

In certain embodiments, the hanger running assembly may include an adapter sleeve that is configured to couple to the hanger and a hanger running tool that extends circumferentially about a periphery of the adapter sleeve. In certain embodiments, the adapter sleeve may enable efficient running and locking of the hanger within the wellhead. In some embodiments, use of the adapter sleeve may advantageously provide sufficient annular space between the adapter sleeve and the wellhead to support the one or more control lines during installation of the hanger.

FIG. 1 is a block diagram of an embodiment of a mineral extraction system 10. The illustrated mineral extraction system 10 may be configured to extract various minerals and natural resources, including hydrocarbons (e.g., oil and/or natural gas), from the earth, or to inject substances into the earth. In some embodiments, the mineral extraction system 10 is land-based (e.g., a surface system) or offshore (e.g., an offshore platform system). As illustrated, the system 10 includes a wellhead 12 coupled to a mineral deposit 14 via a well 16. The well 16 may include a well bore.

The wellhead 12 may include multiple components that control and regulate activities and conditions associated with the well 16. For example, the wellhead 12 generally includes bodies, valves, and seals that route produced minerals from the mineral deposit 14, regulate pressure in the well 16, and inject chemicals down-hole into the well bore. The system 10 may include other devices that are coupled to the wellhead 12, and devices that are used to assemble and control various components of the wellhead 12. For example, in the illustrated embodiment, the system 10 includes a hanger running tool 30 that may be used to lower and/or to install the hanger 28 within the wellhead 12. A pressure controlling system 36 (e.g., a BOP, diverters, spacers, risers, adapters, and the like) may also be included as a part of the mineral extraction system 10. The pressure controlling system 36 may consist of a variety of valves, fittings, and controls to prevent oil, gas, or other fluid from exiting the well in the event of an unintentional release of pressure or an overpressure condition during a drilling phase.

As will be appreciated, the well bore may contain elevated pressures. For example, the well bore may include pressures that exceed 10,000, 15,000, or even more pounds per square inch (psi). Accordingly, the mineral extraction system 10 may employ various mechanisms, such as seals, plugs, and valves, to control and regulate the well 16. For example, plugs and valves are employed to regulate the flow and pressures of fluids in various bores and channels throughout the mineral extraction system 10. For instance, the illustrated hanger 28 is disposed within the wellhead 12 to secure tubing and casing suspended in the well bore, and to provide a path for hydraulic control fluid, chemical injections, and so forth. The hanger 28 includes a hanger bore 40 that extends through the center of the hanger 28, and that is in fluid communication with and provides pressure integrity with a bore of the hanger running tool 30 and a tubing string 20 during an installation phase. To facilitate discussion the mineral extraction system 10 of FIG. 1, and the components therein, may be described with reference to an axial axis or direction 54, a radial axis or direction 56, and a circumferential axis or direction 58.

Figure 2:
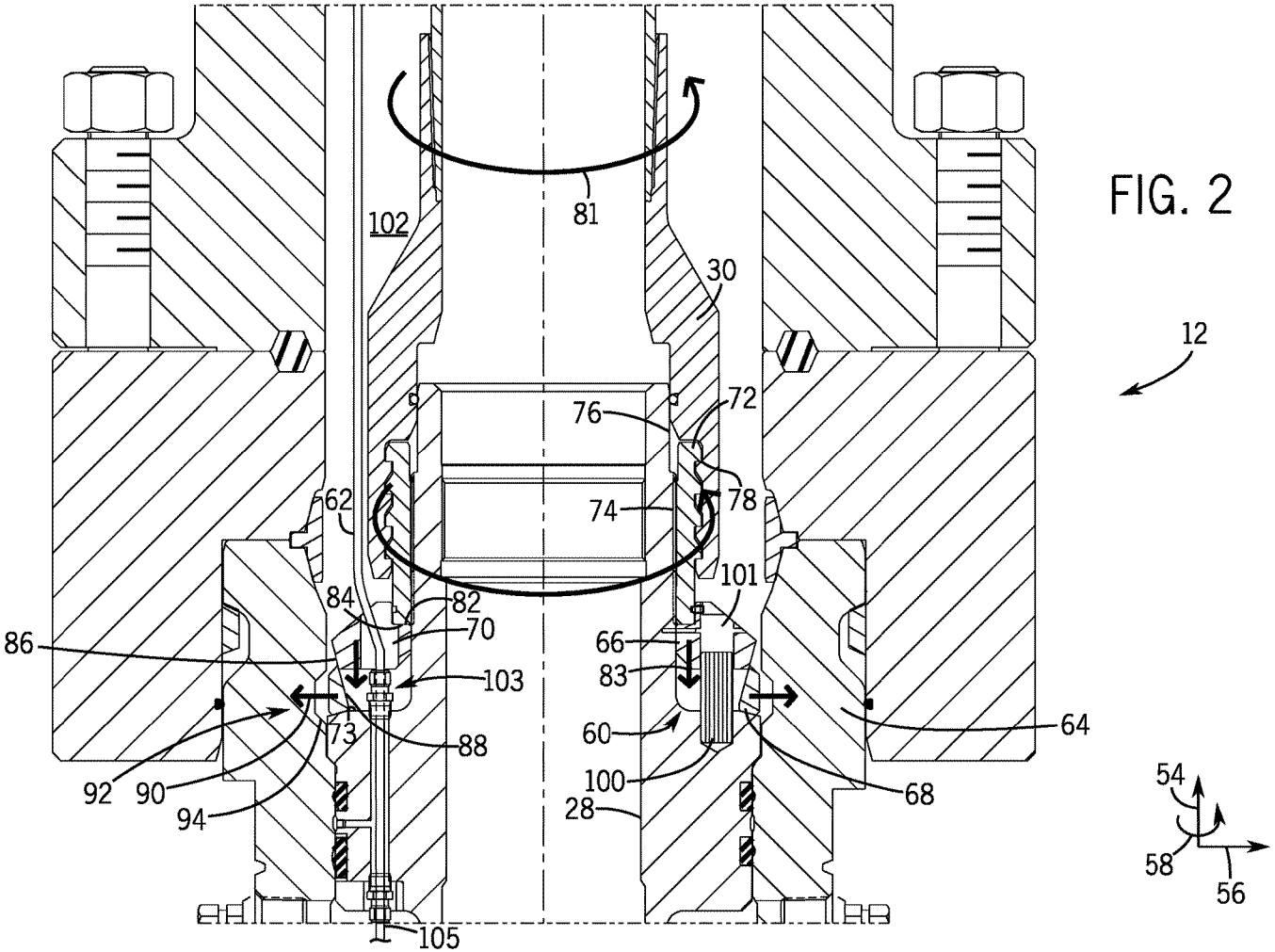
FIG. 2 is a cross-section of an embodiment of a hanger locking assembly that may be used to lock a hanger within a wellhead of the mineral extraction system of FIG. 1.

FIG. 2 is a cross-section of an embodiment of a hanger locking assembly 60 that may be used to lock the hanger 28 within a housing 64 of the wellhead 12. As shown, the hanger locking assembly 60 includes an energizing ring 66 (e.g., annular ring), a locking ring 68 (e.g., annular locking ring), and a retainer ring 72 (e.g., annular retainer ring or hold-down ring). The energizing ring 66, the locking ring 68, and/or the retainer ring 72 may be a continuous annular ring, a split ring (e.g., C-ring, segmented ring, or the like), or a plurality of locking dogs (i.e., radial segments that are spaced apart from one another). The energizing ring 66 includes one or more axially-extending passageways 70 that are each configured to receive and/or to support one or more control lines 62. Although one axially-extending passageway 70 supporting one control line 62 is shown to facilitate discussion, it should be understood that any suitable number (e.g., 1, 2, 3, 4, 5, 6, 7, 8, 9, 10, or more) of axially-extending passageways 70 may be provided at discrete circumferential locations about the energizing ring 66. Furthermore, any suitable number (e.g., 1, 2, 3, 4, 5, 6, 7, 8, 9, 10, or more) of control lines 62 may extend through each axially-extending passageway 70. The axially-extending passageways 70 may have any suitable configuration that enables the one or more control lines 62 to extend across the energizing ring 66. For example, the axially-extending passageways 70 may be through holes, slots formed in an inner circumference (e.g., radially-inner surface or inner periphery), slots formed in an outer circumference (e.g., radially-outer surface or outer periphery), or any combination thereof. The disclosed embodiments may facilitate use and/or monitoring of continuous and/or non-continuous control lines 62 during installation of the hanger 28. Thus, the control line 62 may extend axially from a point axially above the hanger 28 and/or housing 64 (e.g., the surface), through an annular space 102 between the hanger running tool 30 and a pressure controlling system 36 (e.g., a BOP, diverters, spacers, risers, adapters, and the like) installed on top of the housing 64, and through the energizing ring 66. The control line 62 may extend at least across the energizing ring 66 (e.g., from a point axially above the energizing ring 66 to a point axially below the energizing ring 66) during installation of the hanger 28. In the illustrated embodiment, the control line 62 is a continuous control line 62. The continuous control line 62 may be continuous across any axial length, including at least a length across the energizing ring 66 during installation of the hanger 28.

In the illustrated embodiment, a retainer ring 72 has a radially-inner surface 74 that is coupled (e.g., threadably coupled) to a radially-outer surface 76 of the hanger 28. A radially-outer surface 78 of the retainer ring 72 is coupled (e.g., threadably coupled) to the hanger running tool 30. In some embodiments, the hanger running tool 30 is configured to attach to the retainer ring 72 via a quarter turn. In operation, rotation of the hanger running tool 30, as shown by arrow 81, causes rotation of the retainer ring 72 about the threads on the radially-outer surface 76 of the hanger 28, thereby moving the retainer ring 72 axially downward, as shown by arrow 83. In the illustrated embodiment, an axially-facing surface 82 (e.g., a lower surface or annular surface) of the retainer ring 72 is configured to contact or to engage an axially-facing surface 84 (e.g., an upper surface or annular surface) of the energizing ring 66. Accordingly, as the retainer ring 72 moves axially downward, the retainer ring 72 drives the energizing ring 66 axially downward. In the illustrated embodiment, as the energizing ring 66 moves axially downward, a radially-outer contacting surface 86 (e.g., acutely angled relative to a central axis or tapered surface) of the energizing ring 66 contacts a radially-inner contacting surface 88 (e.g., acutely angled relative to a central axis or tapered surface) of the locking ring 68. The locking ring 68 is supported by an upper surface 73 (e.g., annular surface or shoulder) of the hanger 28, and thus, the energizing ring 66 drives the locking ring 68 radially outward, as shown by arrow 90.

In particular, the locking ring 68 moves from an illustrated withdrawn position 92 (e.g., a natural position or non-energized position) in which the locking ring 68 is withdrawn from a corresponding recess 94 of the housing 64 of the wellhead 12 (e.g., enabling axial movement of the hanger 28) to an engaged position in which the locking ring 68 engages the corresponding recess 94 to block axial movement of the hanger 28. Thus, in operation, rotation of components (e.g., the hanger running tool 30, the retainer ring 72, or the like) positioned axially above the energizing ring 66 drives the energizing ring 66 axially downward and causes the locking ring 68 to engage the corresponding recess 94 of the housing 64 of the wellhead 12. As discussed in more detail below, in certain embodiments, the hanger locking assembly 60 may be configured to provide positive locking (e.g., in which hanger 28 movement is blocked) of the hanger 28 within the housing 64 of the wellhead 12.

In certain embodiments, an anti-rotation component 100 (e.g., a fastener, set screw, key, protrusion, notch, slot, or the like) may be provided to block rotation of the energizing ring 66 relative to the hanger 28. In the illustrated embodiment, the anti-rotation component 100 extends axially between the energizing ring 66 and the hanger 28. The anti-rotation component 100 may fit within a corresponding shape 101 (e.g., hole, recess, or groove) to form an anti-rotation interface. The anti-rotation component 100 may be formed in (e.g., fixed to) the hanger 28 and the corresponding groove may be formed in the energizing ring 66, or vice versa. In the illustrated embodiment, the anti-rotation component 100 extends axially into the energizing ring 66 and is configured to enable the energizing ring 66 to move axially relative to the hanger 28, while blocking rotational movement of the energizing ring 66 relative to the hanger 28. Although one anti-rotation component 100 is shown to facilitate discussion, it should be understood that any suitable number (e.g., 1, 2, 3, 4, 5, 6, 7, 8, 9, 10, or more) of anti-rotation components 100 may be provided at discrete circumferential locations about the energizing ring 66. Additionally or alternatively, the anti-rotation component 100 may be positioned at any suitable location and/or have any suitable configuration that enables the anti-rotation component 100 to block rotation of the energizing ring 66 relative to the hanger 28. For example, as discussed below with respect to certain embodiments, the anti-rotation component 100 may extend radially between the energizing ring 66 and the hanger 28.

The anti-rotation component 100 and the axially-extending passageway 70 of the energizing ring 66 may facilitate use of continuous and/or non-continuous control lines, such as the illustrated continuous control line 62, during installation of the hanger 28. Continuous control lines 62 may be continuous (e.g., one-piece and/or devoid of breaks, interruptions, or connections) across any suitable axial length (e.g., at least across the energizing ring 66) during installation of the hanger 28 and/or between a termination point (e.g., in the housing 64 or a christmas tree) and the hanger 28 after termination of the control line 62 following installation of the hanger 28. Because the energizing ring 66 is blocked from rotating relative to the hanger 28 by the anti-rotation component 100, continuous and/or non-continuous control lines may be used during hanger installation without complex components (e.g., bushings) between a first axial location above the hanger 28 (e.g., the surface) and a second axial location that is proximate to the upper surface 73 of the hanger 28. Because the energizing ring 66 is blocked from rotating relative to the hanger 28 by the anti-rotation component 100, each of the one or more control lines 62 may be continuous (e.g., one-piece and/or devoid of breaks, interruptions, or connections) between a first axial location above the hanger 28 (e.g., the surface) and a second axial location that is proximate to the upper surface 73 of the hanger 28. In the illustrated embodiment, the one or more control lines 62 extends below the hanger 28, to reach downhole equipment, via a connection 103, 105 positioned proximate to the upper and lower surface of the hanger 28 and axially below the energizing ring 66.

Prior to installation of the hanger 28, the one or more control lines 62 may be arranged to run axially in the annular space 102 without wrapping the one or more control lines 62 about the hanger 28. During installation of the hanger 28, the one or more control lines 62 may remain suspended in the annular space 102 and extend through the axially-extending passageways 70 of the energizing ring 66 without twisting about and/or contacting the rotating components (e.g., the hanger running tool 30). Advantageously, the illustrated configuration and the embodiments disclosed herein are devoid of costly and/or complex connecting components (e.g., bushings) positioned along the one or more control lines 62 between the energizing ring 66 and a surface above the hanger 28. The illustrated configuration and the embodiments disclosed herein may also enable use of a large number (e.g., more than 5, 6, 7, 8, 9, 10, 11, 12, or more) control lines 62 and/or monitoring characteristics (e.g., pressure) of the control lines 62 during installation of the hanger 28 (e.g., without separating the hanger running tool 30 from the hanger 28 and/or while the hanger running tool 30 remains coupled to the hanger 28). The one or more control lines 62 may be used (e.g., for testing) as the hanger 28 is run and locked into position within the housing 64 of the wellhead 12. The illustrated configuration may enable the hanger 28 to be efficiently run and locked into position within the housing 64 of the wellhead 12 via only a single trip of the hanger running tool 30 through the pressure controlling system 36.

Figure 3:
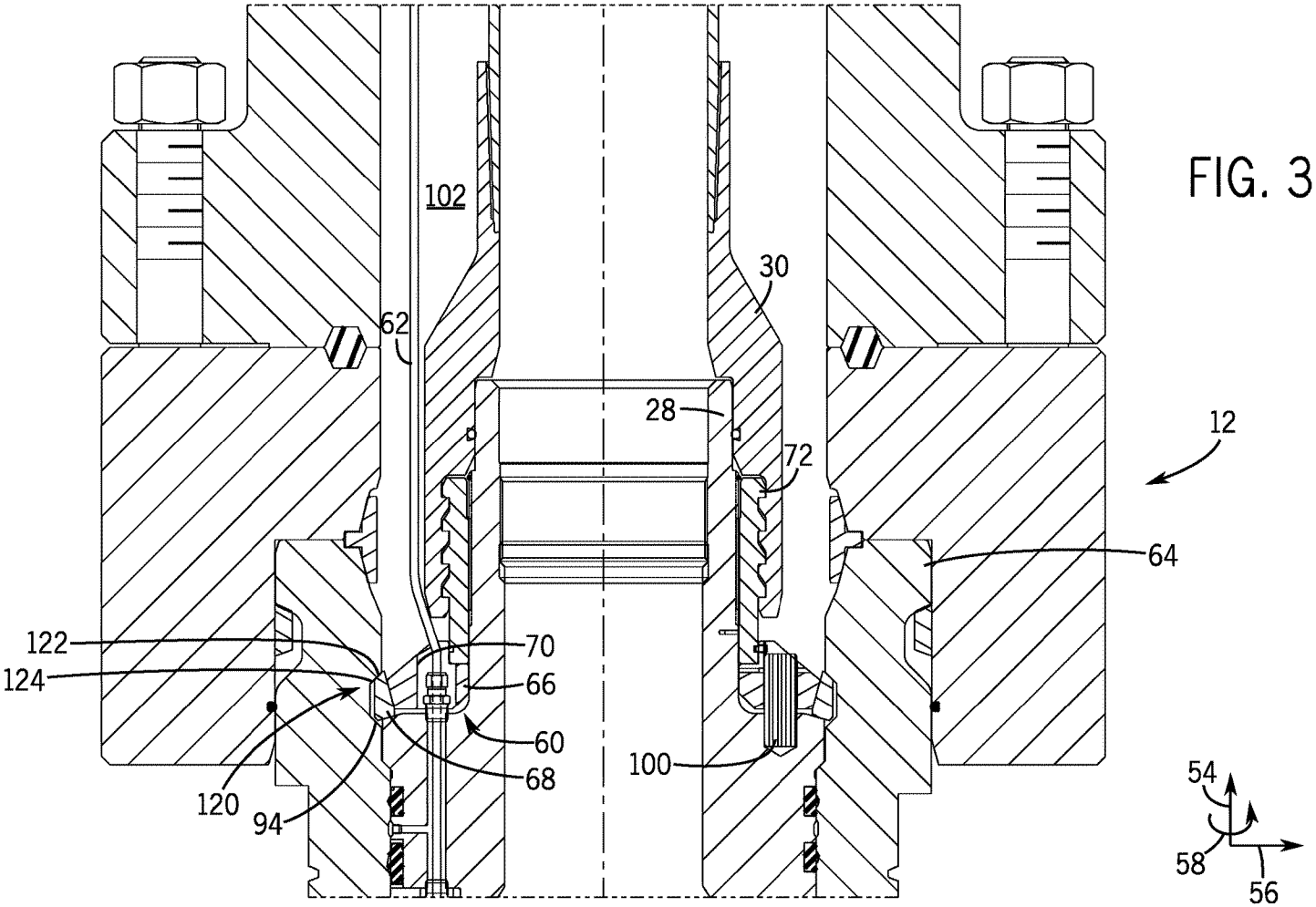
FIG. 3 is a cross-section of the hanger locking assembly of FIG. 2 with a locking ring in an engaged position.

FIG. 3 is a cross-section of the hanger locking assembly 60 with the locking ring 68 in an engaged position 120 (e.g., locked position). As shown, the locking ring 68 is in a positively locked position in which movement of the hanger 28 is blocked. In particular, an upper contacting surface 122 of the locking ring 68 contacts a lower contacting surface 124 of the corresponding recess 94 of the housing 64 of the wellhead 12. When the locking ring 68 is in the illustrated positively locked position, the hanger 28 is blocked from moving axially relative to the housing 64 of the wellhead 12. As shown, the one or more control lines 62 remain in the annular space 102 while the locking ring 68 is in the positively locked position. Thus, again as shown, the hanger running tool 30 may not interfere with (e.g., may not block a flow of fluid through the one or more control lines 62, break, impede, pinch, twist, or the like) the one or more control lines 62 during locking of the hanger 28 and/or while the hanger 28 is locked within the wellhead 12. Thus, the disclosed embodiments may advantageously enable both positive locking and the use of the one or more control lines 62 during installation of the hanger 28.

Figure 4:
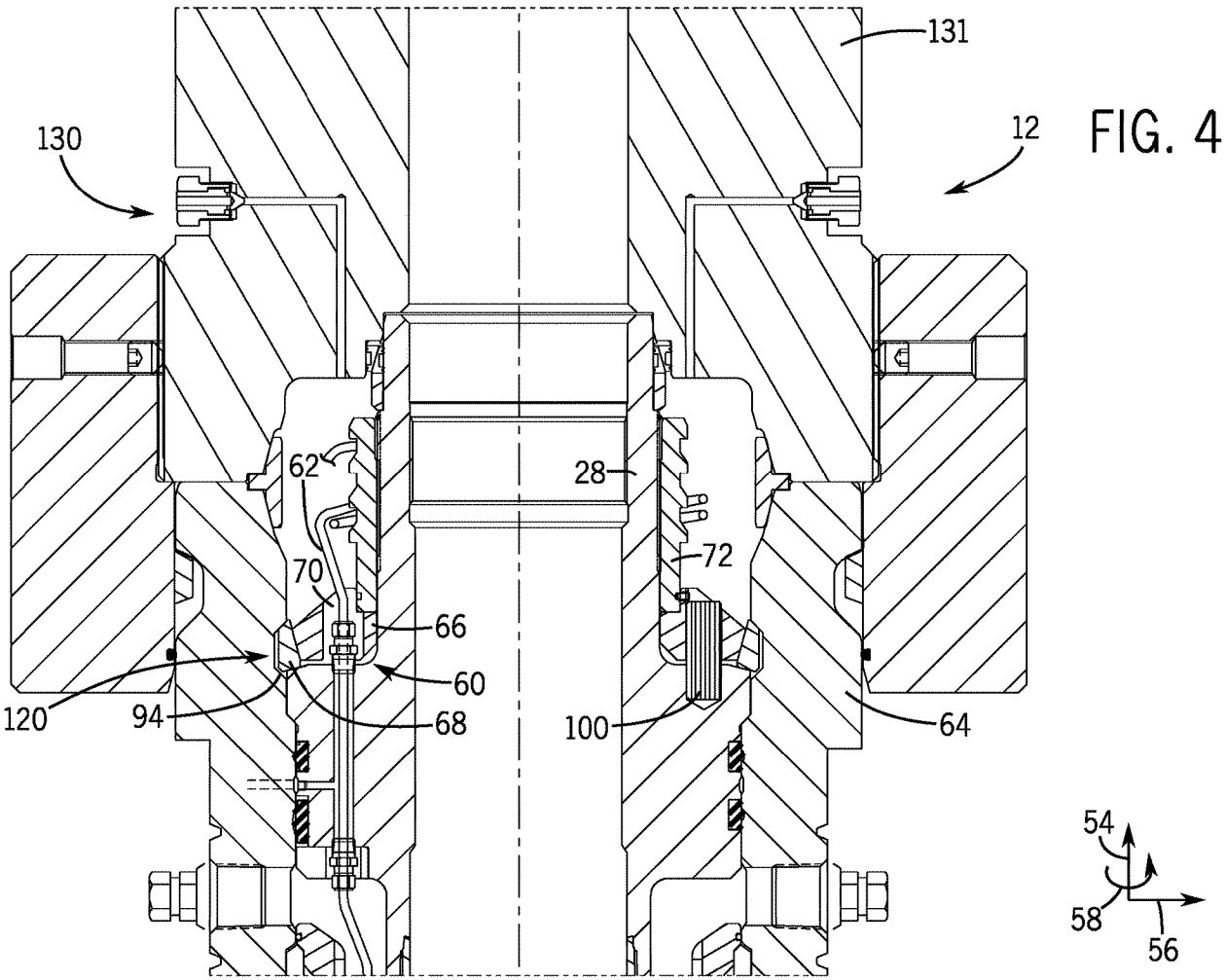
FIG. 4 is a cross-section of the hanger locking assembly of FIG. 2 after removal of a hanger running tool from the wellhead and installation of a bonnet.

FIG. 4 is a cross-section of the hanger locking assembly 60 after removal of the hanger running tool 30 from the wellhead 12 and attachment of a bonnet 131. After the hanger 28 is locked within the wellhead 12, the hanger running tool 30 may be separated from the retaining ring 72 (e.g., via rotation or vertical pull of the hanger running tool 30) and axially withdrawn from the wellhead 12. As shown, the one or more control lines 62 may then be wrapped circumferentially around the hanger 28 and/or terminated (e.g., coupled to respective control blocks 130 or the like) for use during a production phase to monitor and/or to control downhole equipment.

Figure 5:
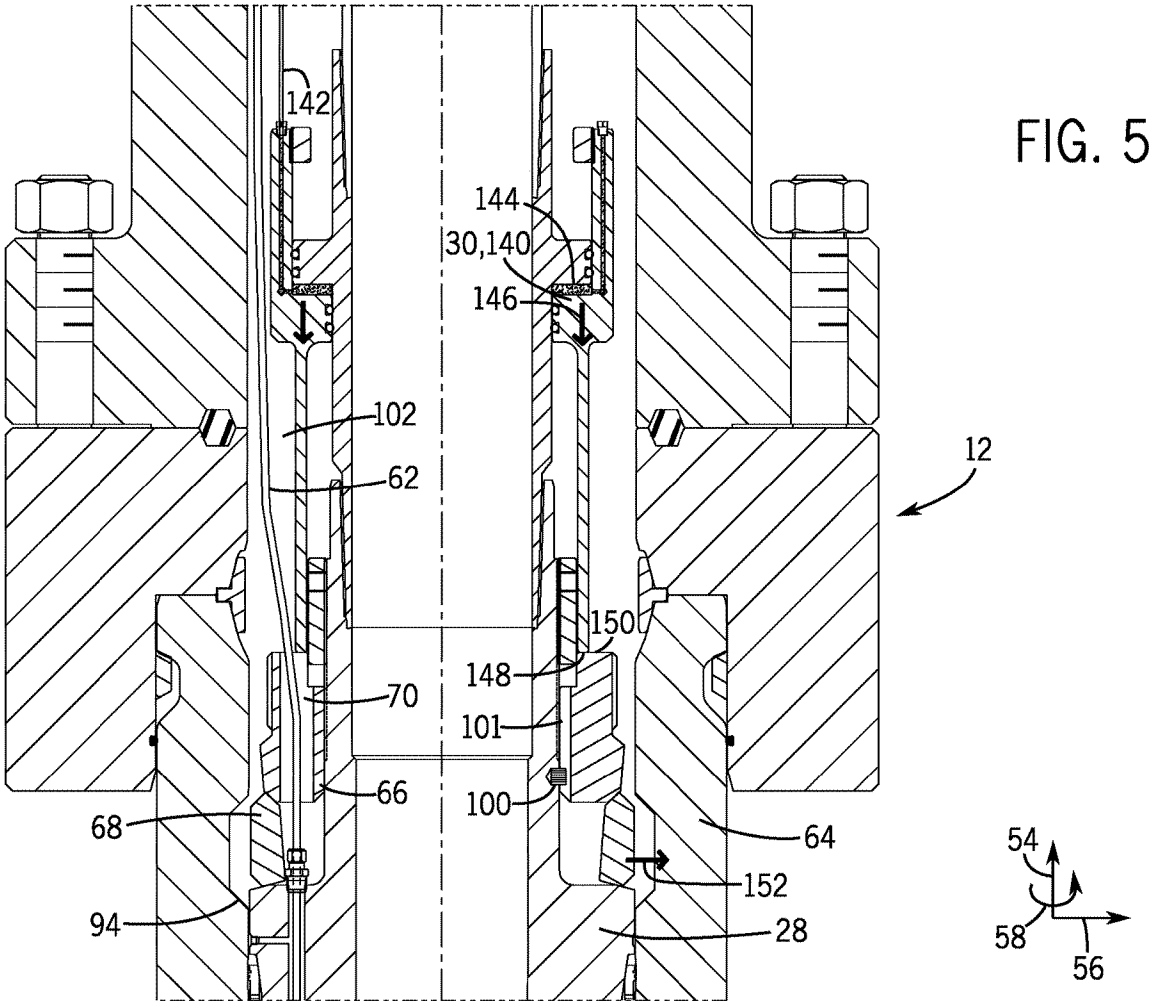
FIG. 5 is a cross-section of another embodiment of a hanger locking assembly and a hydraulic hanger running tool.

The hanger locking assembly 60 and the hanger running tool 30 may have any of a variety of configurations to facilitate running and locking the hanger 28 in only a single trip (e.g., pass) of the hanger running tool 30 with non-continuous and/or continuous control lines 62. FIG. 5 is a cross-section of another embodiment of the hanger locking assembly 60 and the hanger running tool 30. As shown, the energizing ring 66 includes the axially-extending passageway 70 that is configured to receive and/or to support the one or more control lines 62. The anti-rotation component 100 extends radially between the energizing ring 66 and the hanger 28 to block rotation of the energizing ring 66 relative to the hanger 28, thereby facilitating use of the one or more control lines 62 during running and locking the hanger 28.

In the illustrated embodiment, the hanger running tool 30 is a hydraulic running tool 140 (e.g., hydraulically-driven running tool). Hydraulic fluid may be provided via a hydraulic fluid line 142 to a chamber 144 (e.g., annular chamber) to drive the hydraulic running tool 140 axially downward, as shown by arrow 146. An axially-facing surface 148 (e.g., a lower surface or an annular surface) of the hydraulic running tool 140 may contact an axially-facing surface 150 (e.g., an upper surface or an annular surface) of the energizing ring 66. Thus, as the hydraulic running tool 140 moves axially downward, the energizing ring 66 is driven axially downward and drives the locking ring 68 radially outward, as shown by arrow 152. The hydraulic running tool 140 provides sufficient annular space 102 for the one or more control lines 62 and does not interfere with and/or does not contact the one or more control lines 62 during installation of the hanger 28 within the wellhead 12.

Figure 6:
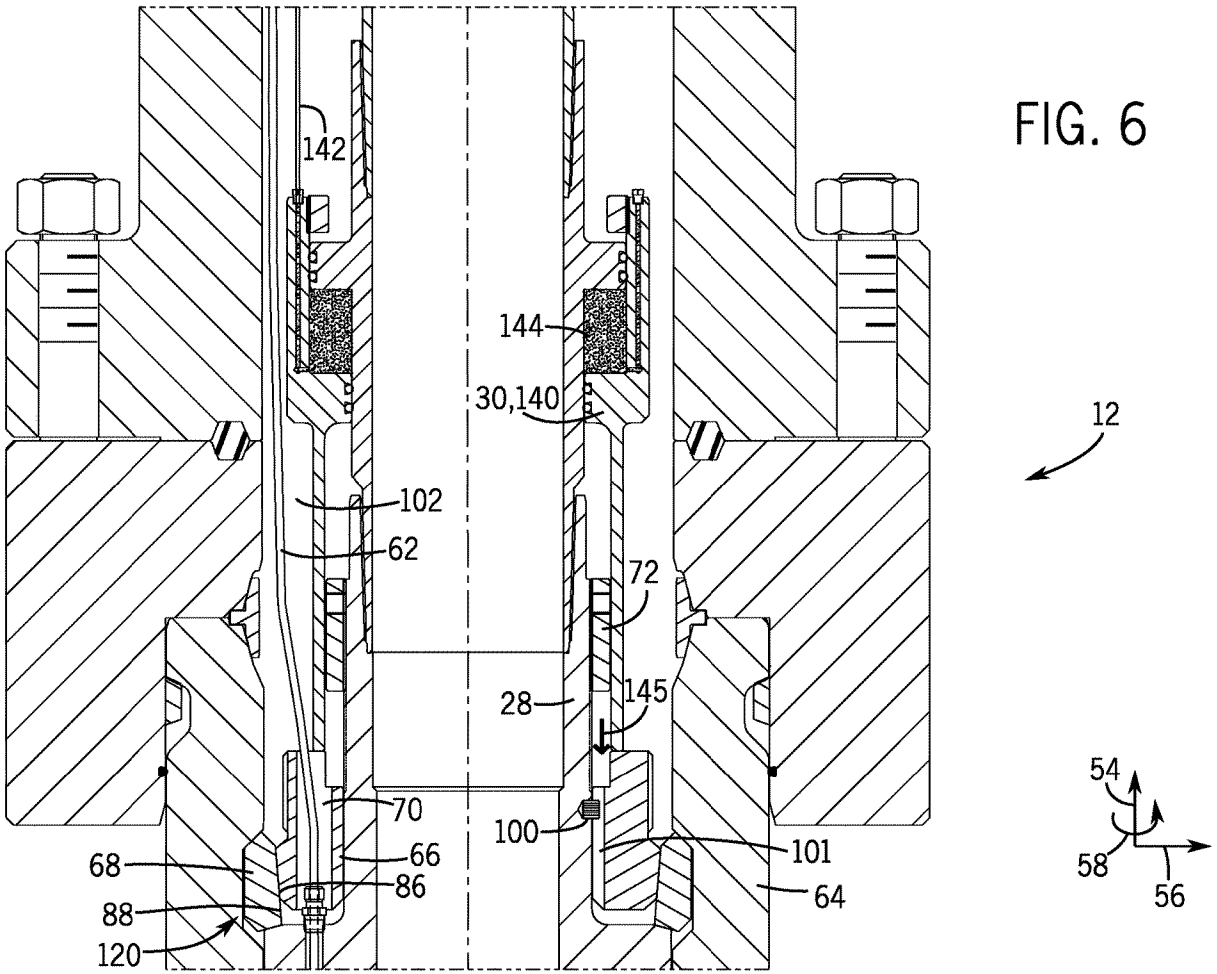
FIG. 6 is a cross-section of the hanger locking assembly of FIG. 5 with a locking ring in an engaged position.

FIG. 6 is a cross-section of the hanger locking assembly 60 of FIG. 5 with the locking ring 68 in the engaged position 120. In the engaged position 120, the locking ring 68 engages the corresponding recess 94 to lock the hanger 28 within the housing 64 of the wellhead 12. The illustrated features may advantageously enable positive locking and/or the use of the one or more control lines 62. In the illustrated embodiment, an angle of an interface between the radially-outer contacting surface 86 of the energizing ring 66 and the radially-inner contacting surface 88 of the locking ring 68 is a steep or acute angle relative to a central axis, which causes the hanger locking assembly 60 to be self-locking (e.g., the locking ring 68 remains in the engaged position 120 after removal of the hanger running tool 30 and/or a force is required to disengage the locking ring 68 from the corresponding recess 94). After the locking ring 68 reaches the engaged position 120, the hanger running tool 30 may be withdrawn (e.g., by pulling vertically upward). In certain embodiments, the retainer ring 72 may be moved axially downward (e.g., by manually or mechanically pushing vertically downward or rotating about the hanger 28) as shown by arrow 145 to contact the energizing ring 66. The retainer ring 72 may be configured to support and/or to maintain the energizing ring 66 and the locking ring 68 in the engaged position 120. It should be understood that any of the various features illustrated and described with respect to FIGS. 2-6 may be combined in any suitable manner to run and lock the hanger 28 within the wellhead 12. By way of non-limiting example, a self-locking ring may be used in conjunction with the rotatable hanger running tool 30 of FIGS. 2-4 and/or an axially-extending anti-rotation component 100 may be used with the self-locking ring of FIGS. 5 and 6.

Figure 7:
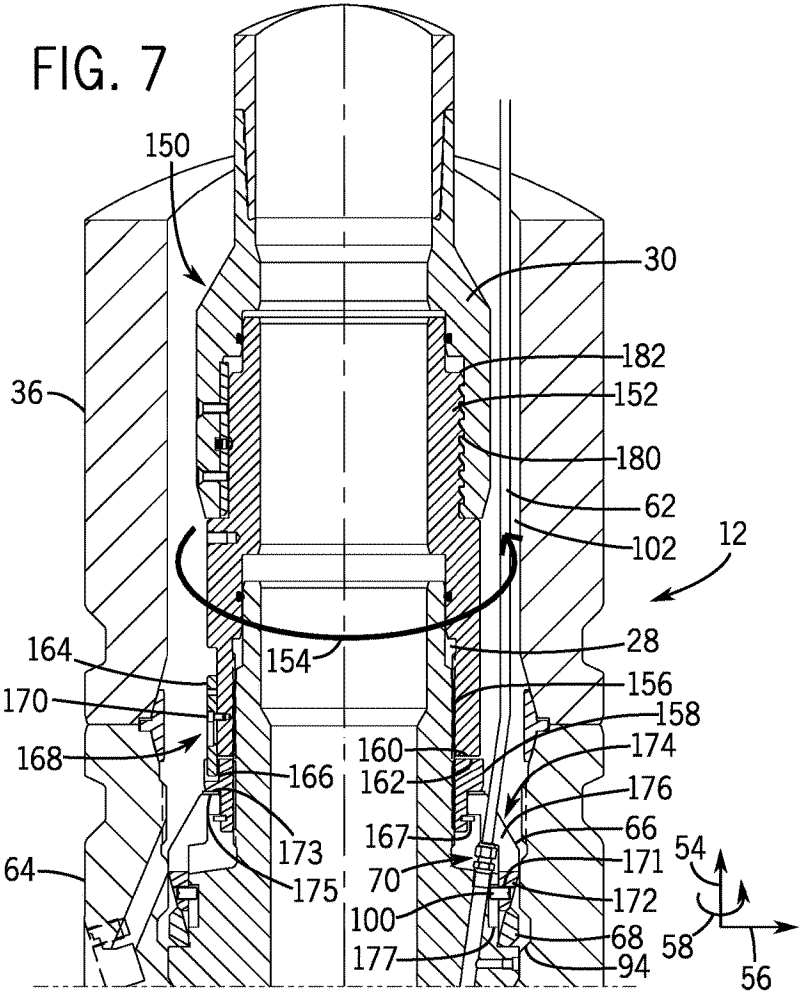
FIG. 7 is a cross-section of another embodiment of a hanger locking assembly and a hanger running assembly having an adapter sleeve and a hanger running tool.

FIG. 7 is a cross-section of an embodiment of a hanger running assembly 150 having an adapter sleeve 152 and the hanger running tool 30. In certain embodiments, the illustrated hanger running assembly 150 may be used in conjunction with the energizing ring 66 having the axially-extending passageways 70 to facilitate positive locking and/or the use and/or monitoring of the one or more control lines 62 during installation of the hanger 28. As shown, the adapter sleeve 152 is an annular sleeve that is coupled (e.g., threadably coupled) to the hanger 28. For example, the adapter sleeve 152 may be rotated relative to the hanger 28 to lower the adapter sleeve 152 about the hanger 28, as shown by arrow 154, and to threadably couple the adapter sleeve 152 to the hanger 28 via a threaded interface 156.

In operation, the adapter sleeve 152 may be lowered (e.g., via rotation) about the hanger 28 toward an actuating ring 158 (e.g., annular actuating ring, retainer ring, or hold-down ring). In some embodiments, the adapter sleeve 152 may be lowered until an axially-facing surface 160 of the adapter sleeve 152 is proximate to and/or contacts an axially-facing surface 162 of the actuating ring 158. A key-slot interface may be provided between the adapter sleeve 152 and the actuating ring 158. The key-slot interface includes a key 164 and a corresponding recess 166. The key 164 may be provided in the adapter sleeve 152 and the corresponding recess 166 may be provided in the actuating ring 158, or vice versa. In the illustrated embodiment, the adapter sleeve 152 may be lowered to an axial position that enables a key 164 (e.g., an engaging member) to engage a corresponding recess 166 formed in the actuating ring 158. The corresponding recess 166 is provided at a discrete circumferential location and extends about only a portion of a circumference of the actuating ring 158 (e.g., about less than the circumference of the actuating ring 158). As shown, the key 164 is in an engaged position 168 in which the key 164 extends into the corresponding recess 166 and blocks rotation of the adapter sleeve 152 relative to the actuating ring 158. Thus, when the key 164 engages the corresponding recess 166, rotation of the adapter sleeve 152 causes rotation of the actuating ring 158. A fastener 170 (e.g., a set screw, pin, or the like) may be tightened (e.g., moved radially-inwardly) to block axial movement of the key 164 and to maintain the key 164 in the engaged position 168. Although one key 164 and one corresponding recess 166 are shown, it should be understood than any suitable number (e.g., 1, 2, 3, 4, 5, 6, 7, 8, 9, 10, or more) of keys 164 and/or corresponding recesses 166 may be provided at discrete circumferential locations (e.g., spaced evenly or unevenly) to block rotation of the adapter sleeve 152 relative to the actuating ring 158.

As shown, the hanger running tool 30 may be coupled to the adapter sleeve 152. In some embodiments, the hanger running tool 30 may be configured to be coupled to the adapter sleeve 152 after the adapter sleeve 152 is coupled to the actuating ring 158 via the key 164. In some embodiments, the hanger running tool 30 and the adapter sleeve 152 may be configured to couple to one another via a quarter turn. For example, teeth 180 (e.g., protrusions or notches) may extend about a portion of a circumference of an outer surface 182 of the adapter sleeve 152. In such cases, the hanger running tool 30 may be axially lowered about the adapter sleeve 152 and rotated a quarter turn to engage the teeth 180, thereby coupling the hanger running tool 30 to the adapter sleeve 152.

Once the hanger running tool 30 and the adapter sleeve 152 are coupled (e.g., via the teeth 180), further rotation of the hanger running tool 30 causes the hanger running assembly 150 (e.g., the hanger running tool 30 and the adapter sleeve 152) to rotate about the hanger 28 via the threaded interface 156. While the key 164 engages the corresponding recess 166 of the actuating ring 158, the actuating ring 158 also rotates about the hanger 28 with the hanger running assembly 30. As the hanger running assembly 150 and the actuating ring 158 rotate, these components move axially, as shown by arrow 154, and drive the energizing ring 66 axially. As shown, a support ring 167 may be provided between the actuating ring 158 and the energizing ring 66 to block axial movement of the energizing ring 66 relative to the actuating ring 158. In turn, the energizing ring 66 drives the locking ring 68 to move radially outward to engage the corresponding recess 94 of the housing 64 of the wellhead 12.

As shown, the energizing ring 66 includes the axially-extending passageway 70 to enable the one or more control lines 62 to extend from the annular space 102 to an axial position below the energizing ring 66, and the anti-rotation component 100 is provided to block rotational movement of the energizing ring 66 relative to the hanger 28. The anti-rotation component 102 may extend from a recess 171 of the energizing ring 66 to a corresponding groove 177 in the hanger 28. In the illustrated embodiment, the energizing ring 66 includes a lower portion 172 and an upper portion 174. The lower portion 172 may be a solid annular ring and the upper portion 174 may include discrete axially-extending members 176 (e.g., circumferentially spaced about the energizing ring 66) that define the axially-extending passageways 70. As shown, a lower axially-facing surface 173 of the actuating ring 158 contacts an upper axially-facing surface 175 of the axially-extending members 176 of the energizing ring 66.

Figure 8:
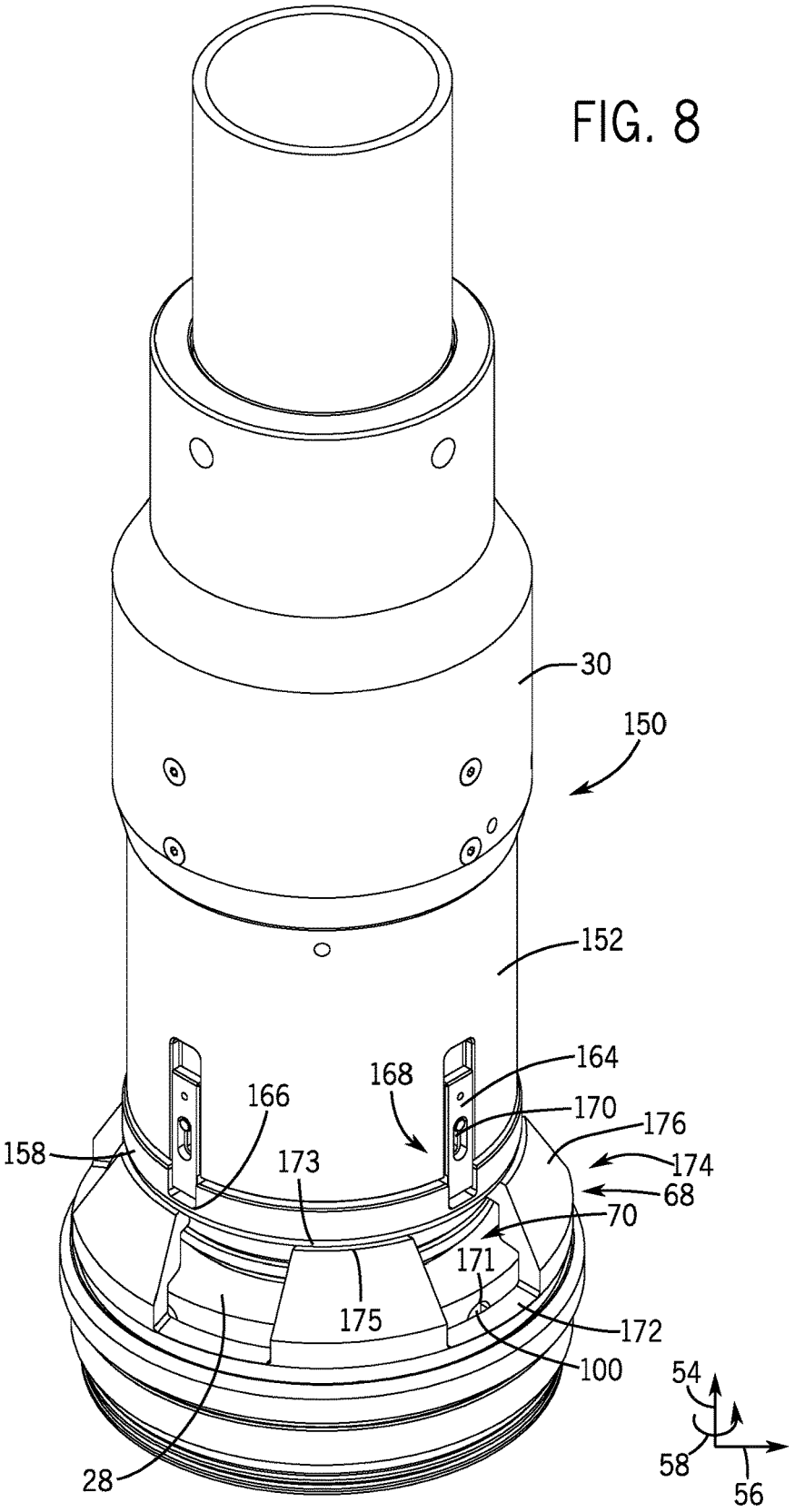
FIG. 8 is a perspective view of the hanger locking assembly and the hanger running assembly of FIG. 7.

FIG. 8 is a perspective view of the embodiment of the hanger running assembly 150 and the locking assembly 60 of FIG. 7. As shown, the hanger running tool 30 is coupled to the adapter sleeve 152. The key 164 is in the engaged position 168 within the corresponding recess 166 of the actuating ring 158, and the fastener 170 may be tightened to block axial movement of the adapter sleeve 152 relative to the actuating ring 158. The energizing ring 66 is positioned axially below the actuating ring 158, and may be secured to the hanger 28 via the anti-rotation component 100 positioned within the recess 171. In the illustrated embodiment, the energizing ring 66 includes the lower portion 172 and the upper portion 174. The lower portion 172 is a solid annular ring and the upper portion 174 includes the discrete axially-extending members 176 that define the axially-extending passageways 70. As shown, the lower axially-facing surface 173 of the actuating ring 158 contacts the upper axially-facing surface 175 of the axially-extending members 176 of the energizing ring 66. While the hanger 28 is run and locked within the housing 64 of the wellhead 12, the one or more control lines 62 may extend through the axially-extending passageways 70 to the hanger 28.

Figure 9:
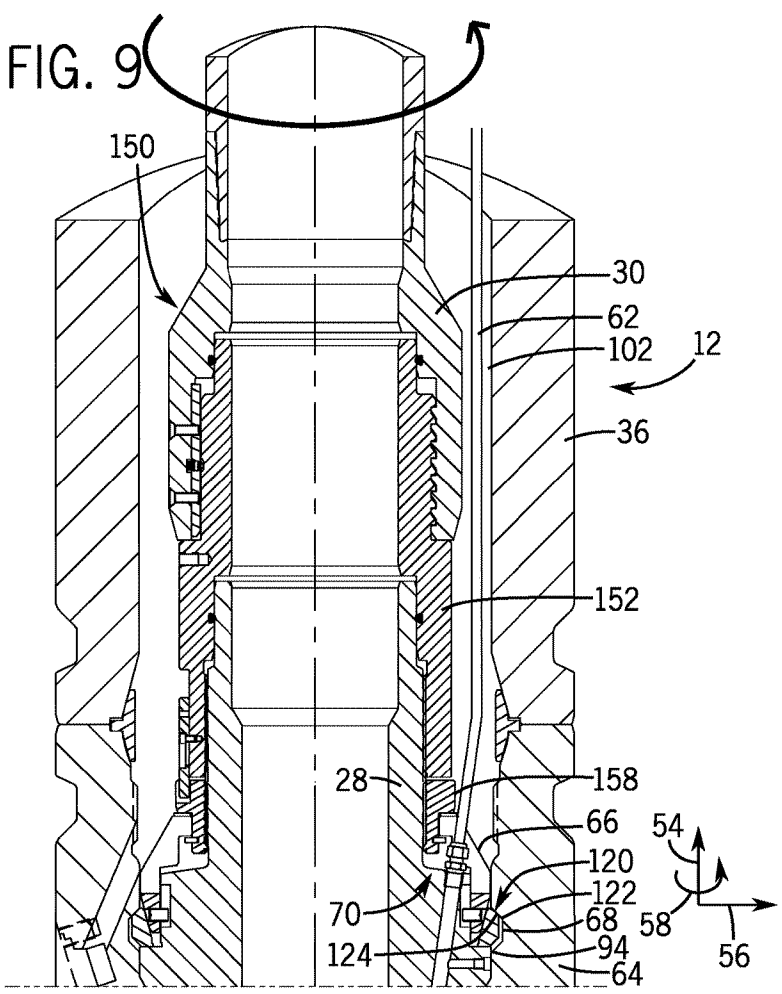
FIG. 9 is a cross-section of the hanger running assembly and the hanger locking assembly of FIG. 7 with a locking ring in an engaged position.

FIG. 9 is a cross-section of the hanger running assembly 150 and the locking assembly 60 of FIG. 7 with the locking ring 68 in the engaged position 120. In the illustrated embodiment, the locking ring 68 is configured to positively lock the hanger 28 within the housing 64. For example, the upper contacting surface 122 of the locking ring 68 contacts the lower contacting surface 124 of the corresponding recess 94 when the locking ring 68 is in the engaged position 120, thereby blocking axial movement of the hanger 28. As shown, the one or more control lines 62 extend from the annular space 102 and through the axially-extending passageways 70 of the energizing ring 66 while the hanger 28 is installed within the housing 64. The illustrated hanger running assembly 150 may provide sufficient annular space 102 for the one or more control lines 62 and the components (e.g., the hanger running tool 30, the adapter sleeve 152, and/or the actuating ring 158) may not interfere with and/or do not contact the one or more control lines 62 during installation of the hanger 28 within the wellhead 12.

Figures 10, 11, 12:
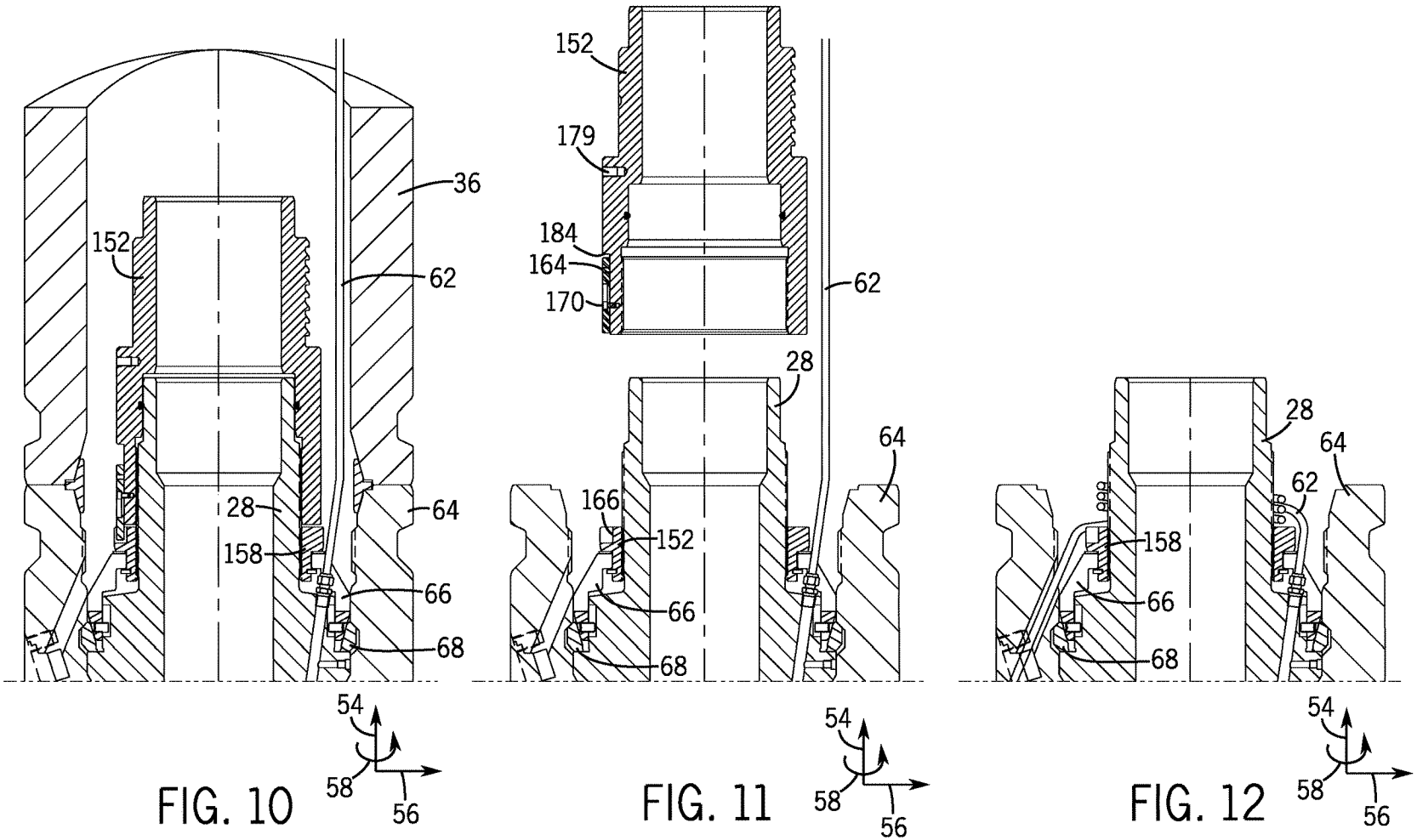
FIG. 10 is a cross-section of the hanger running assembly of FIG. 7 after withdrawal of the hanger running tool from a wellhead.
FIG. 11 is a cross-section of the hanger running assembly of FIG. 7 after separation of the adapter sleeve from a hanger.
FIG. 12 is a cross-section of a portion of a wellhead after installation of a hanger by the hanger running assembly of FIG. 7.

FIG. 10 is a cross-section of the adapter sleeve 152 after withdrawal of the hanger running tool 30 from the wellhead 12. The hanger running tool 30 may be separated from the adapter sleeve 152 by rotating the hanger running tool 30

(e.g., by rotating the hanger running tool 30 a quarter turn in the opposite direction from that used to the couple the hanger running tool 30 to the adapter sleeve 152). As shown, the hanger running tool 30 may be efficiently and simply separated from the adapter sleeve 152 without interfering with and/or contacting the one or more control lines 62 and/or the locking ring 68.

FIG. 11 is a cross-section of the adapter sleeve 152 separated from the hanger 28. In some embodiments, components (e.g., BOP) of the pressure controlling system 36 shown in FIG. 10 may be separated (e.g., unfastened) from the housing 64 to enable access to the adapter sleeve 152. While the adapter sleeve 152 is accessible, the key 164 may be disengaged from the corresponding recess 166 of the actuating ring 158. For example, the fastener 170 may be loosened to enable the key 164 to move axially upward within a groove 184 of the adapter sleeve 152 and out of the corresponding recess 166. Withdrawal of the key 164 from the corresponding recess 166 enables the adapter sleeve 152 to rotate relative to the actuating ring 158 and relative to the hanger 28 along the threaded interface 156 until separated from the hanger 28. The adapter sleeve 152 may be efficiently and simply separated from the hanger 28 without interfering with and/or contacting the one or more control lines 62 and/or the locking ring 68. In some embodiments, the adapter sleeve 152 may include a lifting feature 179 (e.g., a groove, slot, recess, or the like) that facilitates lifting the adapter sleeve 152 and/or components that may be suspended from or attached the adapter sleeve 152 from the wellhead 12.

FIG. 12 is a cross-section of a portion of the wellhead 12 after installation of the hanger 28 within the housing 64 of the wellhead 12. In some embodiments, after removal of the adapter sleeve 152, the one or more control lines 62 may be wrapped circumferentially about the hanger 28 and routed to various down hole devices (e.g., valves) for subsequent operations.

The various components of the present embodiments may have any of a variety of suitable configurations to facilitate use of one or more control lines 62 during installation of the hanger 28. For example, the energizing ring 66 may be positioned between the hanger running assembly 150 (or components thereof, such as the hanger running tool 30, the retainer ring 72, the actuating ring 158, and/or the adapter sleeve 152) and the locking ring 68 that is configured to engage the housing 64 to lock the hanger 28 within the wellhead 12. The energizing ring 66 may be configured to move axially relative to the housing 64 to drive the locking ring 68 into the engaged position 120. In some embodiments, the energizing ring 66 may directly contact the locking ring 68 to drive the locking ring 68 into the engaged position 120.

Figure 13:
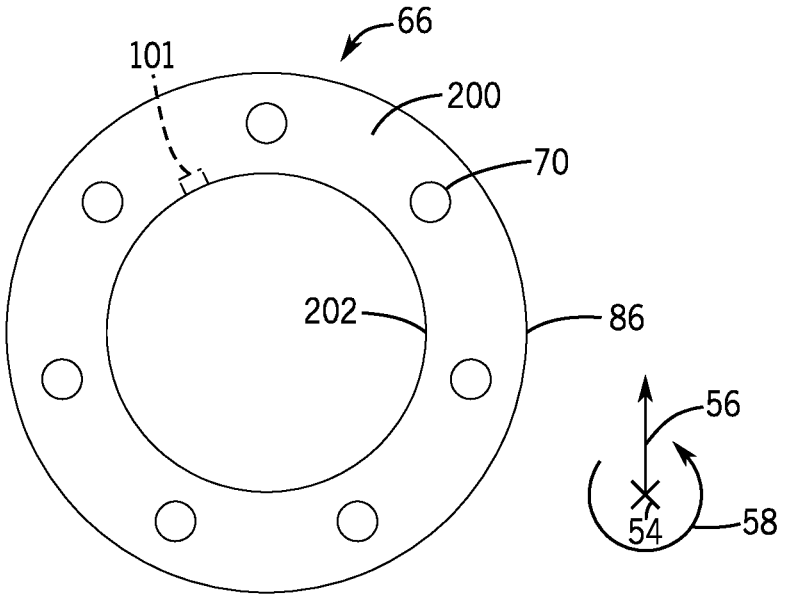
FIG. 13 is a schematic top view of an embodiment of an energizing ring that may be used to facilitate installation of a hanger within a wellhead.

As discussed above, the energizing ring 66 may be coupled to the hanger 28 via one or more anti-rotation components 100 that are configured to block rotation of the energizing ring 66 relative to the hanger 28 during installation of the hanger 28. The energizing ring 66 may also include one or more axially-extending passageways 70 to enable one or more control lines 62 to extend axially across or through the energizing ring 66. FIG. 13 is a schematic top view of an embodiment of the energizing ring 66 that may be used to facilitate installation of the hanger 28 within the wellhead 12. As shown, the axially-extending passageways 70 are through holes extending from an upper surface 200 (e.g., axially-facing surface or annular surface) to a lower surface (e.g., axially-facing surface or annular surface) of the energizing ring 66. In the illustrated embodiment, the axially-extending passageways 70 are positioned radially between the radially-outer contacting surface 86 that may be configured to contact the locking ring 68 and a radially-inner surface 202 that may be positioned proximate to the hanger 28. A portion of the upper surface 200 (e.g., a radially-inner portion, such as the portion 84 shown in FIG. 2) may be configured to contact a component (e.g., the retainer ring 72) of the hanger running assembly 150. In certain embodiments, one or more grooves 101 may be provided to receive the one or more anti-rotation components 100. The groove 101 may be formed in the radially-inner surface 202 of the energizing ring 66 to support a radially-extending anti-rotation component 100 and/or the groove 101 may be formed in the lower surface to support an axially-extending anti-rotation component 100. The one or more grooves 101 may be circumferentially offset from the one or more axially-extending passageways 70.

As noted above, any suitable number of axially-extending passageways 70 may be provided at discrete circumferential locations about the energizing ring 66. The axially-extending passageways 70 may be spaced evenly or unevenly about the circumference of the energizing ring 66. Additionally, while the illustrated axially-extending passageways 70 are generally cylindrical and extend through the energizing ring 66 along an axis parallel to the axial axis 54, it should be understood that each of the axially-extending passageways 70 may have any suitable cross-sectional shape and may curve or bend relative to the axial axis 54 between the upper axially-facing surface 200 and a lower axially-facing surface of the energizing ring 66 to support the one or more control lines 62. The axially-extending passageways 70 may have any suitable configuration that enables the one or more control lines 62 to extend across the energizing ring 66. For example, the axially-extending passageways 70 may be through holes, slots formed in an inner circumference (e.g., radially-inner surface or inner periphery), slots formed in an outer circumference (e.g., radially-outer surface or outer periphery), or any combination thereof.

Figure 14:
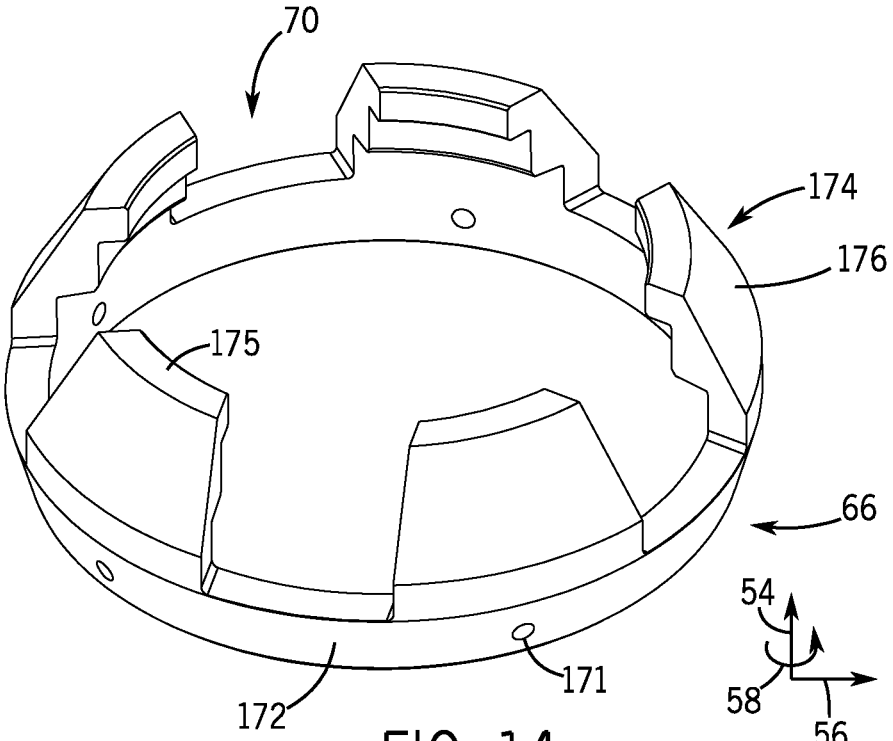
FIG. 14 is a perspective view of another embodiment of an energizing ring that may be used to facilitate installation of a hanger within a wellhead.

FIG. 14 is a perspective view of another embodiment of the energizing ring 66 that may be used to facilitate installation of the hanger 12 within the wellhead 12. The illustrated energizing ring 66 is generally similar in form to the energizing ring 66 shown in FIGS. 7-12. As shown, the energizing ring 66 includes the lower portion 172 and the upper portion 174. The lower portion 172 is a solid annular ring and the upper portion 174 includes discrete axially-extending members 176 circumferentially spaced about the energizing ring 66 that define the axially-extending passageways 70. In the illustrated embodiment, the axially-extending passageways 70 are gaps formed between the axially-extending members 176 of the energizing ring 66. During installation of the hanger 28, the one or more control lines 62 extend through the axially-extending passageways 70 (e.g., gaps) as the energizing ring 66 moves axially relative to the hanger 28 (e.g., via contact between the upper axially-facing surface 175 of the axially-extending members 176 of the energizing ring 66 and the lower axially-facing surface 173 of the rotating actuating ring 158). As noted above, any suitable number of axially-extending passageways 70 defined between the axially-extending members 176 may be provided at discrete circumferential locations about the energizing ring 66. Additionally, the axially-extending passageways 70 may be spaced evenly or unevenly about the circumference of the energizing ring 66. In certain embodiments, one or more recesses 171 may be provided in the energizing ring 66 to receive the one or more anti-rotation components 100. The one or more recesses 171 may be formed in the lower portion 172 of the energizing ring 66. As shown, the one or more recesses 171 may be circumferentially offset from the one or more axially-extending passageways 70.

It should be understood that any of the various features illustrated and described with respect to FIGS. 1-14 may be combined in any suitable manner to run and lock the hanger 28 within the wellhead 12. By way of non-limiting example, the energizing ring 66 of FIG. 14 may be used within the systems illustrated in FIGS. 2-12 and/or a self-locking ring may be used within the systems illustrated in FIGS. 7-12.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A system, comprising:

a hanger locking assembly configured to lock a hanger within a housing of a wellhead positioned above a well, comprising:

an energizing ring comprising one or more axially-extending passageways configured to receive one or more control lines extending from a first axial location above the energizing ring to a second axial location below the energizing ring;

an anti-rotation component extending between the energizing ring and the hanger, wherein the anti-rotation component is configured to block rotational movement of the energizing ring relative to the hanger; and a locking ring in contact with the energizing ring, wherein axial movement of the energizing ring relative to the hanger and in a downward direction toward the well when the hanger locking assembly is positioned within the housing of the wellhead is configured to drive the locking ring radially from a disengaged position in which the locking ring does not contact the housing of the wellhead to an engaged position in which the locking ring extends into a corresponding recess of the housing of the wellhead to block axial movement of the hanger relative to the wellhead.

2. The system of claim 1, wherein the one or more axially-extending passageways are through holes that are configured to circumferentially surround the one or more control lines and that extend from an upper surface of the energizing ring to a lower surface of the energizing ring.

3. The system of claim 1, wherein the energizing ring includes a solid ring portion and a plurality of discrete members extending upward from the solid ring portion, and the axially-extending passageways are defined between adjacent discrete members of the plurality of discrete members.

4. The system of claim 1, comprising a hanger running tool directly or indirectly threadably coupled to the hanger, wherein rotation of the hanger running tool relative to the hanger causes the energizing ring to move axially relative to the hanger to drive the locking ring into the engaged position.

5. The system of claim 1, comprising a hydraulic hanger running tool, wherein a hydraulic fluid is provided to a chamber of the hydraulic hanger running tool to cause the energizing ring to move axially relative to the hanger to drive the locking ring into the engaged position.

6. The system of claim 1, comprising a hanger running assembly comprising:

an adapter sleeve having a lower portion and an upper portion, wherein the lower portion of the adapter sleeve is configured to be coupled to a radially-outer surface of a hanger; and a hanger running tool configured to be coupled to the upper portion of the adapter sleeve.

7. The system of claim 6, comprising an actuating ring positioned axially between the adapter sleeve and the energizing ring, wherein an axially-facing surface of the actuating ring is configured to contact an axially-facing surface of the energizing ring.

8. The system of claim 7, comprising a key-slot interface between the adapter sleeve and the actuating ring, wherein rotation of the hanger running tool and the adapter sleeve causes rotation of the actuating ring when the key is in an engaged position within the corresponding slot.

9. The system of claim 1, wherein the locking ring is a self-locking ring.

10. The system of claim 1, wherein the hanger comprises a radially-extending shoulder, and the axial movement of the energizing ring relative to the hanger is configured to drive the locking ring against the shoulder to cause the locking ring to move from the disengaged position to the engaged position.

11. The system of claim 10, wherein the anti-rotation component extends axially between the energizing ring and the shoulder of the hanger.

12. A method for installing a hanger within a wellhead, comprising:

positioning a locking ring and an energizing ring adjacent to the hanger within the wellhead, wherein the energizing ring comprises one or more axially-extending passageways;

placing one or more control lines through the one or more axially-extending passageways;

threadably coupling a hanger running tool directly or indirectly to the hanger;

rotating the hanger running tool relative to the hanger, thereby causing the energizing ring to move axially relative to the hanger to drive the locking ring from a disengaged position in which the locking ring does not contact a housing of the wellhead and an engaged position in which the locking ring extends into a corresponding recess of the housing of the wellhead to block axial movement of the hanger relative to the wellhead while the one or more control lines extend through the axially-extending passageways.

13. The method of claim 12, comprising coupling an adapter sleeve to the hanger axially above the energizing ring, wherein coupling the hanger running tool directly or indirectly to the hanger comprises coupling the hanger running tool to the adapter sleeve, and rotating the hanger running tool relative to the hanger drives the adapter sleeve and the energizing ring axially relative to the hanger.

14. The method of claim 12, comprising:

positioning an actuating ring axially above the energizing ring;

coupling an adapter sleeve to the hanger axially above the actuating ring;

adjusting a key to engage a corresponding recess of a key-slot interface between the adapter sleeve and the actuating ring;

wherein coupling the hanger running tool directly or indirectly to the hanger comprises coupling the hanger running tool to the adapter sleeve, and rotating the hanger running tool relative to the hanger drives the adapter sleeve, the actuating ring, and the energizing ring axially relative to the hanger.

15. The method of claim 12, comprising wrapping a portion of at least one of the one or more control lines circumferentially about the hanger after the locking ring is in the engaged position.

16. The method of claim 12, wherein the wellhead is positioned above a well, and rotating the hanger running tool relative to the hanger causes the energizing ring to move axially relative to the hanger in a downward direction toward the well to drive the locking ring from the disengaged position to the engaged position.

17. A system configured to run and to lock a hanger within a housing of a wellhead, comprising:

an energizing ring comprising one or more axially-extending passageways configured to receive one or more control lines extending from a first axial location above the energizing ring to a second axial location below the energizing ring;

a locking ring in contact with the energizing ring, wherein axial movement of the energizing ring relative to the hanger is configured to drive the locking ring radially between a disengaged position in which the locking ring does not contact the housing of the wellhead and an engaged position in which the locking ring extends into a corresponding recess of the housing of the wellhead to block axial movement of the hanger relative to the wellhead; and a hanger running tool configured to be directly or indirectly coupled to the hanger, wherein rotation of the hanger running tool causes the energizing ring to move axially relative to the hanger to drive the locking ring into the engaged position.

18. The system of claim 17, comprising an adapter sleeve having a lower portion and an upper portion, wherein the lower portion of the adapter sleeve is configured to be coupled to a radially-outer surface of the hanger via a first threaded interface and the upper portion of the adapter sleeve is configured to be coupled to the hanger running tool via a second threaded interface, such that rotation of the hanger running tool relative to the hanger causes the adapter sleeve to move axially relative to the hanger to contact and to drive the energizing ring to move axially relative to the hanger to drive the locking ring into the engaged position.

19. The system of claim 17, wherein the one or more axially-extending passageways are through holes that are configured to circumferentially surround the one or more control lines and that extend from an upper surface of the energizing member to a lower surface of the energizing member.

20. The system of claim 17, wherein the energizing ring is blocked from rotating relative to the hanger such that rotation of the hanger running tool causes the energizing ring to move only axially relative to the hanger.

* * * * *